US005088399A

United States Patent [19]

Cacace et al.

[11] Patent Number: 5,088,399

[45] Date of Patent: Feb. 18, 1992

[54] APPARATUS FOR COMPACTING SCRAP METAL

[75] Inventors: Antonino G. Cacace, Swansea; Robert Madeley, Poole, both of United Kingdom

[73] Assignee: Camborne Industries PLC, West Glamorgan, United Kingdom

[21] Appl. No.: 586,542

[22] Filed: Sep. 21, 1990

[51] Int. Cl.[5] ..... B30B 15/32; B30B 9/32

[52] U.S. Cl. ..... 100/218; 72/357; 100/229 R; 100/246; 100/252; 100/253; 100/264; 425/354; 425/415

[58] Field of Search ..... 100/215, 218, 232, 244, 100/246, 251, 252, 253, 264, 229 R, 229 A; 72/357, 361; 425/78, 352, 415

[56] References Cited

U.S. PATENT DOCUMENTS

| | | | |
|---|---|---|---|
| 2,218,669 | 10/1940 | Whipple | 100/246 X |
| 2,253,003 | 8/1941 | Whipple | 425/415 X |
| 2,327,117 | 8/1943 | Lorant | 100/252 X |
| 2,882,688 | 4/1959 | Billen et al. | 100/264 X |
| 2,942,298 | 6/1960 | Loedding | 425/354 |
| 3,381,515 | 5/1968 | Orloff | 72/357 X |
| 3,442,404 | 5/1969 | Pioch | 100/229 A X |
| 3,564,993 | 2/1971 | Tezuka | 100/218 X |
| 4,124,338 | 11/1978 | Mitchell . | |
| 4,557,190 | 12/1985 | Vezzani | 100/218 X |
| 4,597,730 | 7/1986 | Rozmus . | |
| 4,666,389 | 5/1987 | Relis et al. | 425/415 X |
| 4,735,761 | 4/1988 | Lindenberger | 425/415 X |

FOREIGN PATENT DOCUMENTS

| | | | |
|---|---|---|---|
| 1452241 | 1/1969 | Fed. Rep. of Germany | 72/357 |
| 62-282740 | 12/1987 | Japan | 72/357 |
| 88/06931 | 9/1988 | PCT Int'l Appl. | 72/357 |
| 806226 | 3/1981 | U.S.S.R. | 72/357 |
| 1313545 | 4/1973 | United Kingdom . | |

*Primary Examiner*—Harvey C. Hornsby
*Assistant Examiner*—Stephen F. Gerrity
*Attorney, Agent, or Firm*—Young & Thompson

[57] ABSTRACT

Pressing apparatus comprising a die made up of a number of segments defining a cavity in which metal swarf is compacted to form a billet. The die segments are held together by one or more sleeves housed in a housing which is mounted on a pedestal which pivots between a first position in which the cavity is aligned with one or more rams which are advanced into the cavity to compact the swarf, and a second position in which the cavity is aligned with gripping devices which grip the ends of the die segments and separate them radially to release the billet after a jacking device mounted on the housing is actuated to move the sleeves in the axial direction and release the die segments. One of the gripping devices may comprise a cylindrical bore through which an empty tube can be fed into the cavity and the other gripping device may similarly comprise a cylindrical bore through which the billet can be fed after it has been ejected from the die cavity. The outer faces of the die segments and the sleeves may be complementarily tapered to assist release of the die segments. The swarf may be compacted in a tube previously inserted in the cavity, the tube constituting a protective jacket around the swarf in the completed billet.

10 Claims, 4 Drawing Sheets

FIG.8
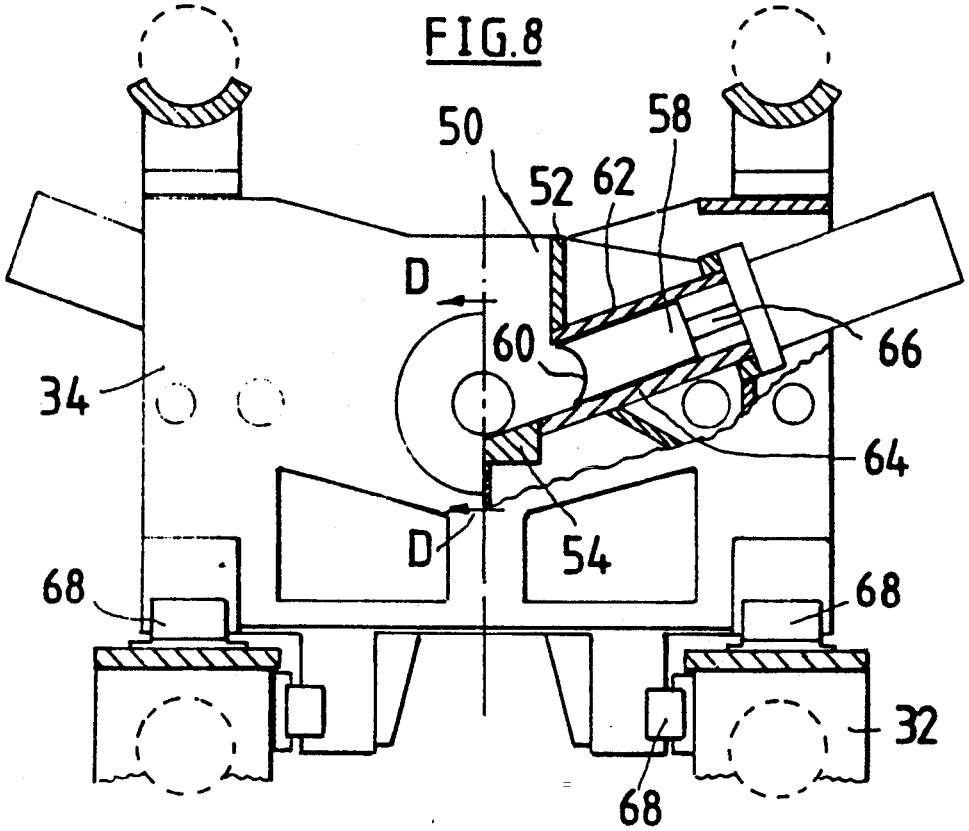
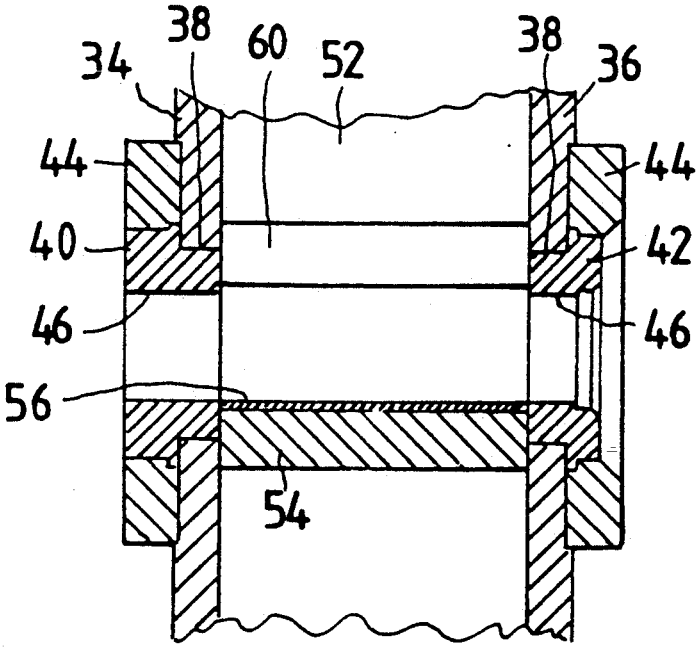
FIG.9

APPARATUS FOR COMPACTING SCRAP METAL

FIELD OF THE INVENTION

This invention relates to the recycling of scrap metal. It has particular application to recycling by rolling or otherwise hot-working a billet made up of scrap metal swarf compacted in a tubular jacket.

The term "swarf" comprehends the off cuts from machining operations in general and is intended to include the off cuts from turning, boring, shaping and milling operations on engineering steels. The fine off cuts from some stamping and punching operations may also be suitable. The term "engineering steel" is intended to describe those low alloy steels which are commonly subjected to machining operations including mild steel (a term which itself includes carbon steel), forging steel and axle or shaft steel all of which contain significant amounts of carbon.

DESCRIPTION OF PRIOR ART

In U.S. Pat. No. 3,774,289 (compare British patent 1,313,545) there is disclosed, inter alia, a process in which steel swarf is pressed into compact masses (which for convenience will be called "briquettes"). The briquettes are pressed together and jacketed in a closed tube, usually of steel or stainless steel. The billet so formed is then heated and worked by a process such as rolling into a finished or semi-finished product.

The forming of the briquettes may take place in a cavity die prior to being jacketed. Alternatively briquettes may be formed directly in the bore of the tube. In this case the tube is inserted in a supporting die during the compaction process and the bore of the tube serves as the cavity. In either case the compaction is carried out by means of a press having a ram which presses a quantity of the swarf previously inserted in the cavity into a briquette. The ram is then withdrawn and a new charge of swarf is inserted in the cavity. The ram is again inserted in the cavity to form a new briquette pressed up against the earlier formed briquette. The cycle is repeated until the cavity is substantially filled up with briquettes.

During the heating the oxides on the swarf inside the jacketing tube are reduced and during the working process the metal particles of which the briquettes are composed are consolidated into a unitary mass which are sintered to each other and to the jacket.

The reduction of oxides on the swarf occurs as a result of the combination thereof with carbon which is either introduced into the jacket or which diffuses out of the steel or other metal of which the swarf is composed. The jacketing tube serves to maintain reducing conditions within the billet. Attempts to produce an acceptable hot worked product from a billet of unjacketed swarf have been unsuccessful even when great care was taken to try to prevent atmospheric oxygen from getting to the hot billet.

As the swarf is compacted by the ram to form a briquette it has a tendency to expand in a radial direction. As a result considerable radial forces are applied to the cavity wall. Where the briquettes are being formed directly in a tube these forces tend to cause the tube to expand radially. The radial expansion of the tube is such that steps must be taken to prevent the tube from being jammed in the cavity of the die in which it is supported. The method of doing so has been provide that the cavity of the die is tapered so that the cavity decreases in diameter towards the end adjacent which the ram is located. After the tube is filled with briquettes it is driven out of the die by the ram. The release of the tube from the cavity is assisted by the taper.

It is advantageous to use relatively long tubes in the process. For example, the economic viability of the process becomes questionable if tubes much less than 1 meter long are used and it would be of great economic advantage if tubes of 2 meters in length could be used.

To be effective the angle of taper of the cavity should be about 3°. Thus, if a die cavity which is 1 meter long to accommodate the tube has a 3° taper, the wide end of the cavity will have a diameter about 10 mm greater than the narrow end. This would increase to 20 mm if the die cavity was 2 meters in length. The tube inserted in the die cavity is initially parallel (i.e. of constant diameter throughout its length). To be able to fit in the die cavity the diameter of the tube would thus have to be less than that of the cavity at its narrow end. As a result a tube of 1 meter in length will be diametrally expanded at one end by about 10 mm until it comes into contact with the cavity wall; and a tube of 2 meters in length would be similarly expanded by about 20 mm.

OBJECT OF THE INVENTION

It is an object of the invention to provide a means for assisting the release of the billet from the die which avoids need to use a die with a tapered cavity.

SUMMARY OF THE INVENTION

According to the invention there is provided pressing apparatus for compacting swarf to form a billet characterised in including:

(a) a die comprising at least two die portions which can mounted together in a working position in which they define a cavity along an axial direction of which a compacting ram can be advanced to compact swarf inserted in the cavity or in a jacket mounted in the cavity to form the billet;

(b) at least one sleeve which can be mounted over the die in a holding position in which it surrounds the die portions and holds them together in the working position; and (c) release means to move the sleeve from the holding position to release the die portions and allow them to move apart in a direction transverse to the axial direction to assist the release of the billet.

According to one aspect of the invention the cavity is cylindrical and each die portion embodies an angular segment of the cavity which segment extends the full length of the die. Advantageously the die comprises four die portions each of which embodies a 90° segment of the cavity.

According to another aspect of the invention the die has an outer face having a tapered portion which tapers inwardly in the axial direction towards an end of the die at which the cavity emerges, the sleeve being mounted over the tapered portion and having an inner face which tapers complementally to the tapered portion, the release means being arranged to move the sleeve in the axial direction to release the die portions. It is of advantage that the cavity has two openings which emerge at opposite ends of the die and through which opposed compacting rams can be advanced into the cavity, the die having an outer face provided with two tapered portions which taper inwardly in the axial direction one towards each end of the die, two said sleeves being provided which are mounted one over each of the tapered portions and each having an inner face which tapers complementally to the tapered portion over which it is mounted, the release means being arranged to move the sleeves away from each other in the axial direction to release the die portions.

In one form of the invention the tapered portions taper from a position at or close to the longitudinal centre of the die towards the ends of the die, each sleeve being of axial length substantially equal to that of the tapered portion over which it is mounted.

According to another aspect of the invention the die, the sleeves and the release means are mounted on a support, pivot means being provided to pivot the support between a billet compacting position in which the compacting rams are aligned with the cavity and a billet removing position in which the compacting rams are disposed at an angle to the cavity, means being provided for removing the billet from the die in the billet removing position. In one form of the invention the means for removing the billet comprises a further ram which can be advanced into the cavity to eject the billet.

According to yet another aspect of the invention the support comprises a housing in which the sleeves are slidably mounted and the release means comprises at least one jacking member anchored on the housing and arranged to jack the sleeves away from each other.

The apparatus may, according to the invention include gripping means for gripping the ends of the die portions and for moving the die portions apart to assist the release of the billet, the gripping means including at least one jacking assembly comprising a first jack member and as many gripping members as there are die portions, the gripping members being mounted on the first jack member and being arranged each to grip the end of a die portion when the first jack member is advanced towards the end of the die, and actuating means for moving the gripping members transversely to the axial direction to move the die portions apart.

In one aspect of the invention the gripping members and the ends of the die portions are provided with interlocking formations by means of which the die portions are gripped by the gripping members. In another aspect the actuating means comprises a second jack member, one of the said jack members being provided with a cylindrical passage in which the other said jack member is slidably mounted, the other said jack member being also provided with a cylindrical passage therethrough which is in axial alignment with the cavity of the die when the die is in the billet removing position and through which the said further ram for ejecting the billet from the die can pass.

BRIEF DESCRIPTION OF THE DRAWINGS

The invention is further discussed with reference to the accompanying drawings in which:

FIG. 8 is an enlarged partly sectional view in the axial direction of a charge box forming part of the apparatus shown in FIG. 1; and FIG. 9 is a sectional view on arrows D—D in FIG. 8.

DETAILED DESCRIPTION OF THE EXAMPLES SHOWN IN THE DRAWINGS

Figure 1:
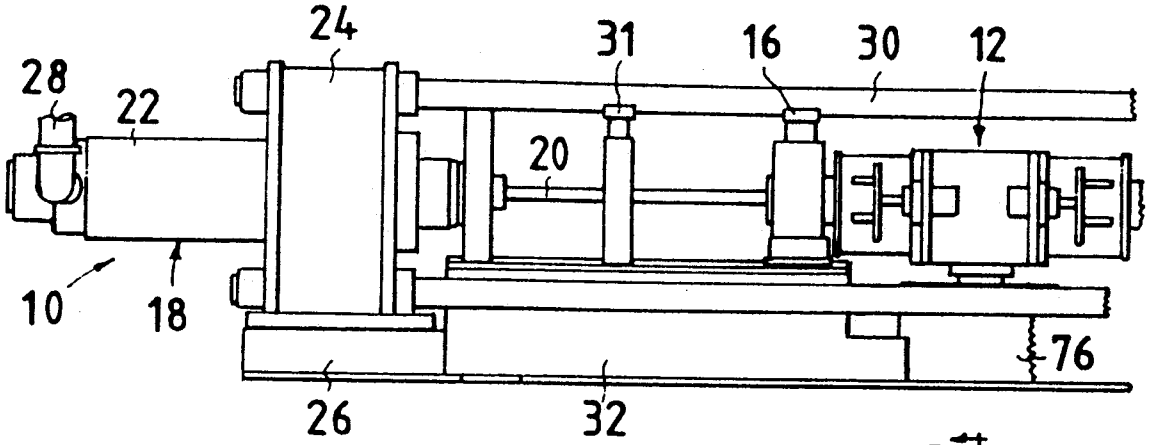
FIG. 1 is a side elevation of part of an apparatus for loading swarf into a die assembly and for compressing the swarf to form a billet.
Figure 2:
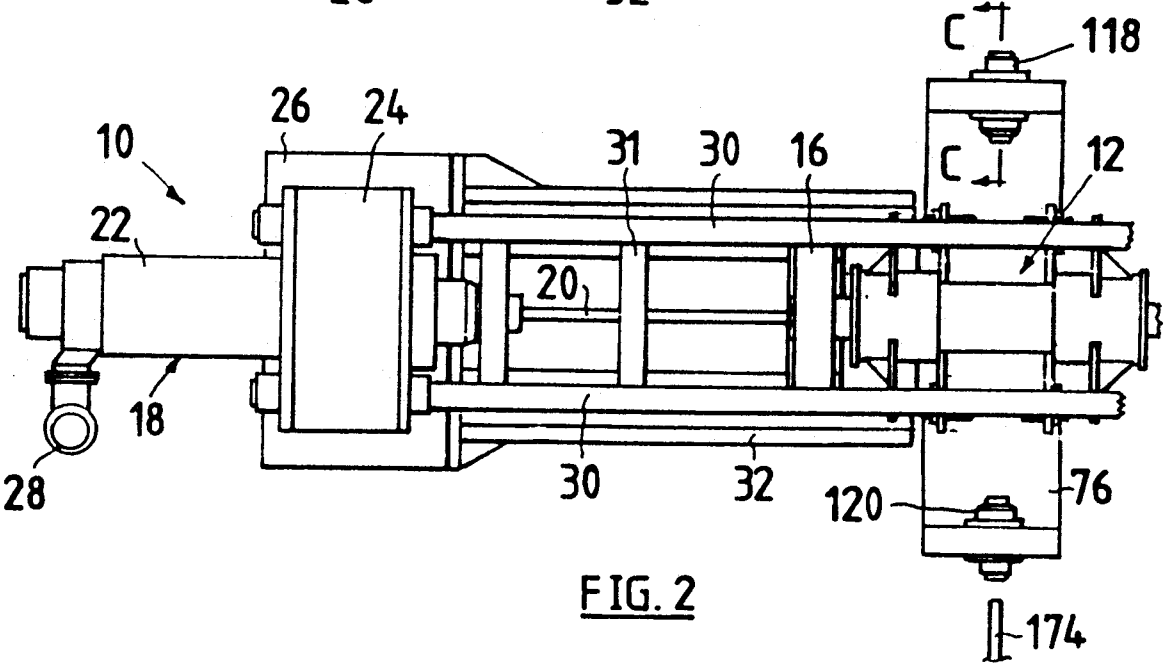
FIG. 2 is a plan view of the apparatus shown in FIG. 1.
Figure 3:
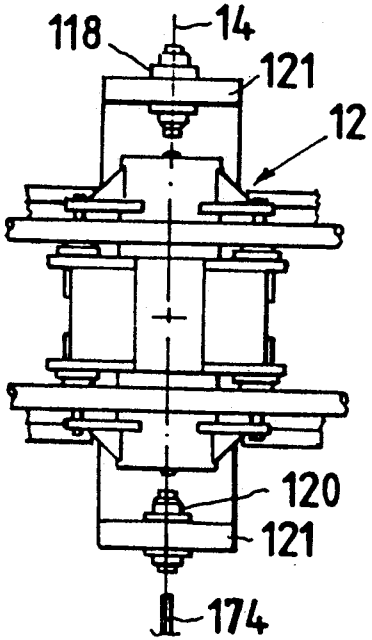
FIG. 3 is a plan view of part of the apparatus shown in FIG. 1 with the die assembly rotated through 90°.

Referring first to FIGS. 1 to 3, there is shown an apparatus 10 for inserting swarf into a jacketing tube and compacting it to form a billet. The apparatus comprises a die assembly 12 and is symmetrical about a vertical plane through an axis 14 through the center of the die assembly. Since the components on either side of the axis 14 are identical only those to one side thereof are illustrated and described.

The components illustrated comprise a charge box 16 and a ram assembly 18. The ram assemblies are axially aligned. Each ram assembly comprises a ram 20 mounted in an hydraulic cylinder 22. The cylinder is supported in a frame 24 mounted on a bed 26. The cylinder is fed with hydraulic fluid pumped by pumps (not shown) from a reservoir (also not shown) through a feed pipe 28. The frames 24 are joined by tie rods 30. The ram 20 is steadied by a steady 31 which can slide on a bed 32. The steady helps to prevent bending of the ram when it is under load.

Also mounted for sliding on the bed 32 is the charge box 16. Referring particularly to FIGS. 8 and 9, the charge box comprises front and rear walls 34, 36 provided with apertures 38. The apertures 38 are aligned with the ram 20 and are provided with replaceable hardened steel collars 40, 42 held in place by rings 44 bolted to the walls. The collars have bores 46 in which the ram is a close sliding fit. A feed chamber 50 is provided having sides 52 and a bottom 54 extending between the front and back walls 34, 36. The bottom, which may be provided with a hardened wear liner 56, is approximately level with the lower periphery of the bores 46. The feed chamber has an open top through which swarf is fed from a storage hopper (not shown). Swarf drops into the path of the ram when the ram is retracted from the feed chamber. When the ram is again advanced a plug of swarf is driven ahead of it through the bore of the collar 42 and into the die as will be explained.

There is a tendency for some of the swarf to migrate upwardly back into the feed chamber rather than into the die. This may be countered by providing a pair of jaws 58 each having a hemi-cylindrical front face 60. The jaws are mounted between upper and lower guide walls 62, 64. Each jaw can be retracted by a small hydraulic ram 66 to a position in which its front face 60 forms the lower part of the side 52 of the feed chamber. This allows the swarf to fill the bottom of the feed chamber as shown in FIG. 8. The jaws can then be advanced until they meet. In this position the jaws hold captive a plug of swarf which can then be driven into the die by the ram.

The charge box is provided with adjustable pads 68 on which it slides along the bed 32 for a reason to be explained. It is moved along the bed by rams (not shown).

Figure 4:
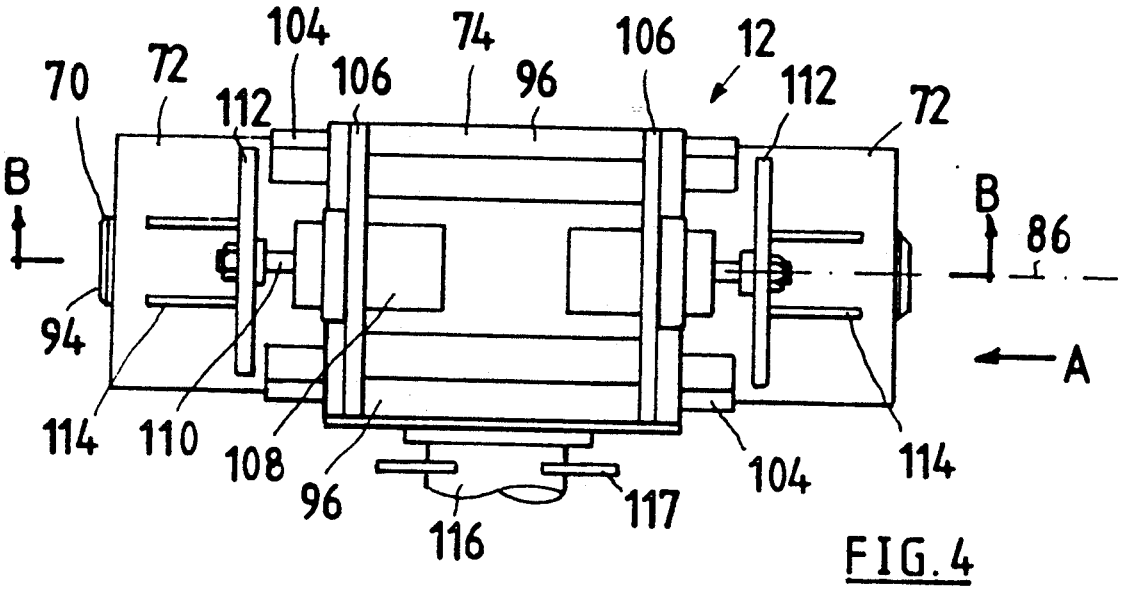
FIG. 4 is an enlarged side elevation of the die assembly.
Figure 5:
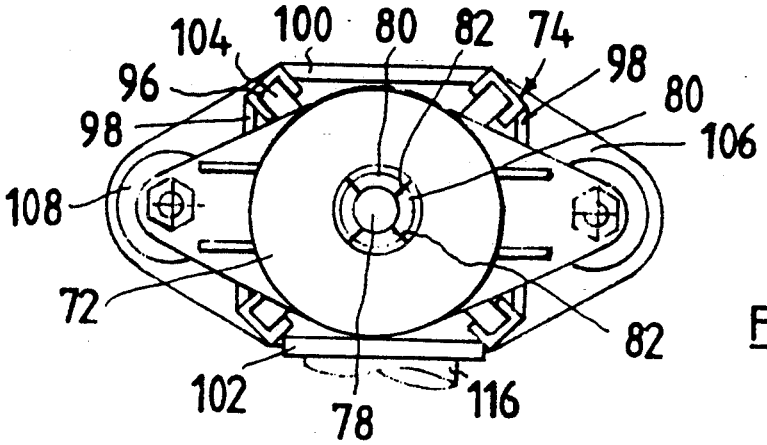
FIG. 5 is an end elevation of the die assembly, viewed from the direction of arrow A in FIG. 4.
Figure 6:
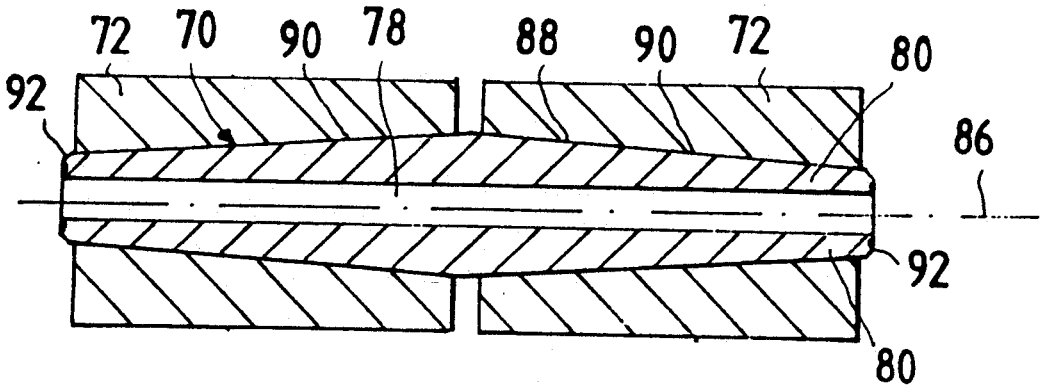
FIG. 6 is a cross sectional view on arrows B—B in FIG. 4, some of the components of the die assembly being omitted.

Referring more particularly to FIGS. 4 to 6, the die assembly 12 comprises a die 70 and a pair of clamping sleeves 72. The die assembly is supported in a housing 74 which is itself mounted on a bed 76.

The die 70 comprises a cylindrical cavity 78 open at both ends. The die is split into four substantially identical portions 80 each embodying a 90° angular segment of the cavity. The die portions thus meet at longitudinally extending interfaces 82 lying in (imaginary) planes which intersect along a line coincident with the longitudinal axis 86 of the die. In the present example the planes are disposed at 45° to the horizontal. The cavity 78 is of uniform circular cross-section throughout its length and is intended to accommodate a tube in which swarf will be compacted as will be described to produce a billet for carrying out the process of recycling scrap steel disclosed in U.S. Pat. No. 3,774,289.

The die has a cylindrical outer face 88 comprising portions 90 which taper inwardly towards both ends 92 from an (imaginary) plane through the longitudinal centre of the cavity and perpendicular to the axis 86. The angle of taper is about 4°.

Two thick walled sleeves 72 of high tensile steel are placed around the tapered portions 90 of the die. The bores of the sleeves are tapered complementally to the tapered portions 90 of the dies. The length of each sleeve is substantially equal to half of that of the die allowing for a small (but essential) working clearance between the inner ends of the two sleeves and a short length of the die at each end (as shown at 94) which projects from the sleeve.

As explained above the tube tends to be radially expanded when swarf is being compacted into briquettes therein. This has the result that the billet tends to be jammed in the cavity and also that substantial forces are transmitted to the die in a radial direction. The sleeves 72 serve to take up the bending stress applied to the die portions and to clamp them together when the billet is being formed. The billet can however be easily released from the die by providing release means which move the sleeves away from each other in the axial direction and allowing the die portions to separate from each other in a radial direction.

This is achieved by mounting the sleeves 72 in the housing 74. In the present example the housing comprises four heavy section channel members 96 of fabricated steel disposed parallel to each other at the corners of a square and joined by heavy steel side walls 98, a top wall 100 and a bottom wall 102, all welded together and stiffened if necessary by gussets. A rail 104 is located in each channel. Mounting bolts and jack screws (not shown) are provided to fix the rails in the channels and to set them up parallel to one another. The rails are set up so that the sleeves 72 are a close sliding fit in the rails, flats being machined into the outer faces of the sleeves for the purpose.

Two mounting plates 106 are mounted on each of the housing. A double acting die releasing jack 108 is mounted on each mounting plate. The rams 110 of the jacks are connected to trunnion plates 112 welded two on each sleeve 72 and stiffened by gussets 114. The jacks 108 can be actuated first to move the sleeves apart in the axial direction to release the billet and thereafter to draw the sleeves towards each other to clamp the die portions together.

The housing 74 is mounted on pivot means which in the present example comprises a pedestal 116 bolted to the bottom 102 of the housing. The pedestal is set in the bed 76 so as to be capable of pivoting about the horizontal axis 14. Rams (not shown) connected between the bed 76 and arms 117 on the pedestal serve to rotate the housing through 90° between the position shown in FIGS. 1 and 2 and the position shown in FIG. 3. In FIGS. 1 and 2 the die is positioned with its cavity 78 axially aligned with the swarf compacting rams 20. In FIG. 3 the cavity is between and in axial alignment with die gripping means comprising, in the present example, two substantially similar die gripping assemblies 118, 120 mounted on frames 121 which are fixed on the bed 76. The construction of only one of them is shown in detail.

Figure 7:
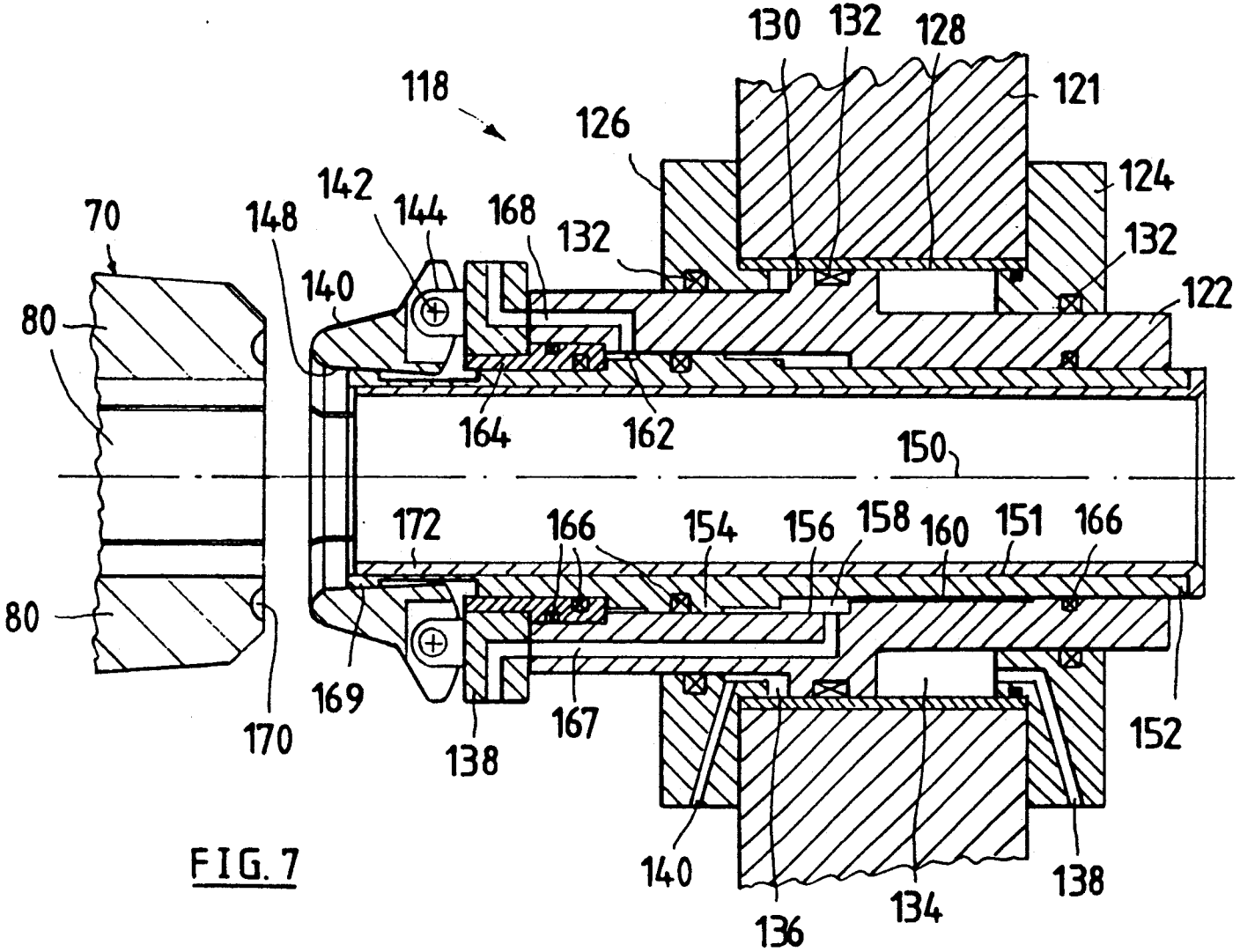
FIG. 7 is an enlarged cross sectional view on arrows C—C in FIG. 1 of a die gripping and expanding mechanism.

Referring to FIG. 7, the assembly 118 comprises an outer tubular jack 122. This jack will be referred to as a die gripping jack and is a close sliding fit in the bores of two collars 124, 126 bolted to the frame and set into opposite ends of a lined passage 128 bored in the frame 120. The die gripping jack has an annular shoulder 130 which slides in the passage 128. Hydraulic seals 132 are provided in the bores of the collars and in the shoulder. Sealed annular chambers 134, 136 are thus defined between the shoulder 130 and the collars 124, 126 respectively. A passage 138 is bored in the collar 124 for feeding hydraulic fluid into the chamber 134. A similar passage 140 for feeding fluid to the chamber 136 is bored in the collar 126. Thus if fluid is fed into the chamber 134 the jack 122 is forced inwardly towards the die assembly and if fluid is fed into the chamber 136 the jack 122 is forced away from the die assembly.

An annular flange 138 is bolted to the inner end of the jack 122. Four jaws 140 are mounted on the flange by means of pins 142 carried between pairs of lugs 144 equally spaced around the flange. Each jaw 140 has a rounded nose and an inner face 148 which tapers inwardly away from the nose. When the jaw pivots about the pin 142 the nose moves towards or away from the longitudinal axis 150 of the jack.

The assembly 118 is also provided with jaw actuating means which in the present example comprises an inner tubular jack 152 which will be referred to as a billet release jack because it actuates the jaws to release a billet from the die cavity. This jack has an outwardly projecting annular shoulder 154 which is a close sliding fit in the bore 156 of the die gripping jack 122. A first annular chamber 158 is defined between the shoulder 154 and an inwardly projecting shoulder 160 machined in the bore of jack 122. A second annular chamber 162 is defined between the shoulder 154 and an insert 164 set into the bore 156 and held in place by the flange 138. The chambers 158, 162 are sealed by hydraulic seals 166. A passage 167 is bored in the flange 138 and the body of the die gripping jack 122 for feeding fluid to the chamber 158. A similar passage 168 feeds fluid to the chamber 162. Thus if the chamber 158 is pressurised the billet release jack moves in the bore of the die gripping jack towards the die assembly and if the chamber 162 is pressurised the billet release jack moves away from the die assembly.

At its end adjacent the die assembly the outer face of the billet release jack is provided with a tapered portion 169 which tapers complementally to the inner faces 148 of the jaws. The inner faces of the jaws bear on the tapered portion 169. Thus when the billet release jack moves away from the die assembly the noses of the jaws are forced away from the axis 150 against the action of springs (not shown) inserted between the jaws and the flange 138. Similarly, when the billet release jack moves towards the die assembly the noses of the jaws move inwardly towards the axis under the action of the springs.

An annular recess 170 is provided in each end face of the die 70. This recess 170 is complemental to the shape of the rounded noses of the four jaws 140. Thus the outer jacks of both of the gripping assemblies can be advanced until the noses of the jaws enter the recesses 170 and the die is gripped firmly between the die gripping jacks. Provided the sleeves 72 have been slackened off the billet release jacks can now be moved away from the die assembly. This will force the four die portions 80 outwardly away from the axis, carried by the noses of the jaws, to free the billet in the cavity.

The bore 151 of the billet release jack 152 of each of the assemblies 118, 120 is provided with a hardened steel liner 172 the diameter of which is slightly larger than that of the die cavity 78. The reason for this is, in the case of the assembly 120, to allow an empty tube for a billet to pass through the bore of the billet release jack into the die cavity when the die is being gripped by the gripping assemblies. A tube feed mechanism (not shown) brings an empty tube into line with the axis 150 and the tube is pushed through the jack by a feed ram 174. The construction and operation of the ram 174 is conventional and it is therefore not necessary to describe it or show it in detail.

After the billet is formed and has been released by the die the ram 174 is advanced through the assembly 120 and pushes the billet out of the die and through the bore of the billet release jack of the assembly 118.

The sequence of operations of the entire apparatus commences with the die assembly in the position shown in FIG. 3. The die cavity 78 is axially aligned with the gripping assemblies 118, 120. The die portions are separated and the die cavity is empty. An empty tube is pushed by the ram 174 through the gripping assembly 120 and into the die cavity. The billet release jacks 152 are retracted to cause the jaws 140 to bring the die portions together. The sleeves 72 are drawn towards one another to clamp the die portions together. The die gripping jacks are withdrawn to release the die. The pedestal 116, carrying the housing 74 and the die assembly 70, is pivoted to the position shown in FIGS. 1 and 2. The die cavity 78 is now axially aligned with the compacting rams 20. The charge boxes are advanced along the beds 32 so that the bevelled ends of the die which project from the sleeves are received in the rebates in the rings 44 of the charge boxes. The rams are now cyclically advanced and retracted to feed charges of swarf from the charge boxes 16 into both ends of the die cavity at the same time. The charges of swarf are compacted into briquettes in the tube located within the die cavity. When the tube is filled up with briquettes the rams 20 and the charge boxes are retracted. The die assembly is pivoted back to the position shown in FIG. 3. The die gripping jacks 122 are advanced to grip the ends of the die. The billet release jacks 152 are retracted to separate the die portions in the radial direction and release the billet. The ram 174 is advanced to eject the billet from the die cavity and push it through the gripping assembly 118 from where it drops onto a roller conveyor (not shown) and is removed. The cycle begins again.

The entire operation is desirably automated and computer controlled.

The manner of further processing and working the billets formed by the use of the present invention will be fully understood by reference to the aforementioned U.S. Pat. No. 3,774,289. The formed billet is subsequently heated and subject to a process such as rolling to form a finished or semifinished product.

Many modifications are possible. For example the swarf may be compacted by a single compacting ram and charge box operating from one end of the cavity. A ram at the opposite end of the cavity serves only as an abutment to block the cavity. However, the provision of dual compacting rams and charge boxes enables the length of the billet to be substantially increased. The reason for this is that the rams must apply great force to the swarf to compact it into briquettes which are as dense as possible. For example if the diameter of the briquettes is about 100 mm it has been found by experience that a compaction force of about 600 tonnes must be applied to mild steel swarf to achieve a briquette which has a density of about 85% of solid steel. Under such a compaction force there would be a serious danger of bending a long ram. For this reason it is considered that it would be impractical to form a 2 meter long billet with a single ram.

The tubes in which the swarf is compacted may be dispensed with, the swarf being compacted in the die cavity.

The angle of taper of the outer face of the die is chosen to suit the coefficient of friction between the surfaces of the sleeves and the die. In light duty apparatus the outer face may not need to be tapered at all. However, for heavier duty, if the angle of taper is too low the sleeves may tend to jam against the die after the tube has been filled. If the angle of taper is too high the sleeves may be ineffective to clamp the die portions together as they are pushed off the die by the resultant of the forces applied to the die.

Although two sleeves 72 are illustrated, this is not essential. For example, the die may be tapered from one end to the other and surrounded by a single sleeve.

The outer face of the sleeve (and consequently the interior of the housing) can be given any suitable shape.

Similarly, while the die is illustrated as comprising four die portions, this number may be varied. In other cases the die may comprise two or three die portions.

Although hydraulically actuated rams and jacks would usually be most practical, mechanical or other actuation means might be preferred. In the above example, the each sleeve need not be moved more than about 25 mm in the axial direction by the jacks 108. They may however be separated in a much greater distance. For example, the sleeves may be mounted in frames which slide on beds so that the sleeves can be separated by a distance greater than the length of the die. This may be desirable if the die assembly cannot be pivoted to load the tubes and unload the billets from the die. In this case the die portions may be mounted on rams or other mountings which separate them radially a distance sufficient to allow the billet to drop therebetween.

It is not considered essential that the die portions should always extend the full length of the die cavity. There may, for example, be cases in which it is desirable to split the die transversely as well as longitudinally.

The die cavity need not necessarily be cylindrical. It could for example be of square cross section. It could also be tapered from one end to the other to further assist the release of the billet.

The die gripping jacks could be located inside the billet release jacks. In this case the billet release jacks could be linked to the jaws by links connected at locations radially outwardly of the pins 142. Movement of the billet release jacks away from the ends of the die would thus open the jaws.

Due to the abrasive nature of swarf, it will be clear that hardened linings may beneficially be provided on the wearing surfaces of the apparatus.

It is not intended that the scope of a patent granted in pursuance of the application of which this specification forms a part should exclude modifications and/or improvements which are within the spirit of the invention as defined in the claims appended hereto or be limited by details of the embodiments described and/or illustrated further than is necessary to distinguish the invention from the prior art.

What we claim is:

1. Pressing apparatus including a die comprising at least two die portions which together define a cavity in which swarf is compacted by a compacting ram advanced along an axis of the cavity to form a billet; at least one sleeve mounted for movement over the die to hold the die portions together; release means for moving the sleeve in the axial direction and releasing the die portions; and at least one die portion separating device which is axially spaced from one end of the die and is provided with die gripping means and means to advance the die gripping means into engagement with said one end of the die and to move the die portions apart transversely to the axis of the cavity.

2. Pressing apparatus according to claim 1, wherein the die and the sleeve are mounted on a support and pivot means is provided to pivot the support between a first position in which the compacting ram is aligned with the cavity and a second position in which the compacting ram is disposed at an angle to the cavity, and means for removing the billet from the die when the support is in the second position.

3. Pressing apparatus according to claim 2, wherein the means for removing the billet includes a further ram which can be advanced into the cavity to eject the billet.

4. Pressing apparatus according to claim 3, wherein the apparatus includes two said die portion separating devices which, when the support is in said second position, are located one at each end of the die, one of said die separating devices being provided with a bore through which the further ram passes when it is advanced into the cavity, the other of said die separating devices being provided with a bore through the billet passes when it is ejected from the cavity.

5. Pressing apparatus according to claim 1, wherein the cavity has two openings at opposite ends of the die and through which opposed compacting rams can be advanced into the cavity, the die having an axially extending outer face provided with two tapered portions which taper inwardly from a position adjacent a longitudinal center of the die one towards each end of the die, two said sleeves being provided which are mounted one over each of the tapered portions, each sleeve having an inner face which tapers complementarily to the tapered portion over which it is mounted and being of axial length substantially equal to that of the tapered portion over which it is mounted, the release means being adapted to move the sleeves away from each other towards the respective ends of the die.

6. Pressing apparatus according to claim 5, wherein the support comprises a housing in which the sleeves are slidably mounted and the release means comprises at least one jacking member anchored on the housing and arranged to jack the sleeves away from each other.

7. Pressing apparatus according to claim 1, wherein said at least one die portion separating device comprises a first jack member on which is mounted as many gripping members as there are die portions, the gripping members being arranged each to grip the end of a die portion when the first jack member is advanced towards the end of the die, and actuating means for actuating the gripping members to move the die portions apart.

8. Pressing apparatus according to claim 7, wherein the actuating means comprises a second jack member.

9. Pressing apparatus according to claim 8, wherein the first jack member is provided with a cylindrical passage in which the second jack member is slidably mounted.

10. Pressing apparatus according to claim 7, wherein the gripping members and the ends of the die portions are provided with interlocking formations by means of which the die portions are gripped by the gripping members.

* * * * *